United States Patent [19]

Runstein

[11] Patent Number: 4,934,711

[45] Date of Patent: Jun. 19, 1990

[54] WORD AND CATEGORY GAME

[76] Inventor: Neil W. Runstein, 209 - 35th East, Seattle, Wash. 98112

[21] Appl. No.: 392,789

[22] Filed: Aug. 11, 1989

Related U.S. Application Data

[63] Continuation-in-part of Ser. No. 188,317, Apr. 29, 1988.

[51] Int. Cl.[5] ..... A63F 1/00; A63F 3/00

[52] U.S. Cl. ..... 273/272; 273/299

[58] Field of Search ..... 273/272, 299

[56] References Cited

U.S. PATENT DOCUMENTS

| | | | |
|---|---|---|---|
| 912,547 | 2/1909 | Edwards | 273/299 X |
| 1,061,999 | 5/1913 | Grondahl | 273/269 |
| 1,312,278 | 8/1919 | Shinn | 273/299 |
| 2,752,158 | 6/1955 | Brunot et al. | 273/272 |
| 3,393,914 | 7/1968 | Hill | 273/272 |
| 3,948,526 | 4/1976 | Lukacik | 273/272 X |
| 4,014,548 | 3/1977 | Trilling | 273/272 |
| 4,059,273 | 11/1977 | Kindred | 273/265 |
| 4,306,724 | 12/1981 | Brzezinski et al. | 273/243 |
| 4,384,722 | 5/1983 | Higgins | 273/272 |

OTHER PUBLICATIONS

Four Letter Frenzy ® Game Instructions, copyrighted by Game Concepts, 1987, copy in 273-299.

*Primary Examiner*—Anton O. Oechsle
*Attorney, Agent, or Firm*—James R. Vance

[57] ABSTRACT

The present invention is a word game having a plurality of letter tiles and category cards. The game may also include a letter bag, a plurality of letter racks, and/or a playing board. By taking turns, individual letter tiles are drawn at random by players. If a drawing player chooses to use that drawn letter tile in the composition of a word relating to a randomly selected category identified on a current category card, that player may place that letter tile on that player's letter rack. If the player discards the letter tile, the letter tile is placed face-upward within a designated playing area, such as upon the game board. During each player's turn, such player may exchange individual letter tiles between his or her letter rack and the game board in an effort to spell a word belonging to the designated category. When a person correctly composes a complete word which belongs to the chosen category, the round is ended and points are allocated. Players with partial answers which correctly belong to the chosen category receive points. Additionally selected letter tiles which do not belong within a word related to the chosen category nullify earned points and/or earn negative points.

28 Claims, 3 Drawing Sheets

FIG. 5

| CATEGORY | LETTERS | SCORE | EXPLANATION |
|---|---|---|---|
| Team Sports | BASEBALL | 16 | Answer |
| Team Sports | BSEBALL | 7 | Partial Answer |
| Sports Equipment | BASEBALL | 16 | Answer |
| Sports Equipment | BASEBALLS | 18 | Answer (Plural) |
| Team Sports | BASEBALLS | 0 | Wrong Category |
| Sports Equipment | BASLLLZ | 0 | Unused Letters (LZ) |
| Lakes | ERIE | 8 | Answer |
| Lakes | LAKE ERIE | 16 | Answer |
| Birds | BLUE | 4 | Partial Answer |
| Birds | BLUEBIRD | 16 | Answer |
| Trees | PINE TREES | 18 | Answer |
| Trees | PINES | 10 | Answer |
| Trees | MYRTLE | 12 | Answer |
| Trees | MERTL | 0 | Wrong Spelling |
| Trees | MRTLE | 5 | Partial Answer |
| Trees | MIRTL | 0 | Unused Letter (I) |
| Trees | TOMAT | 0 | Wrong Category |
| Trees | CHRISTMAS | 18 | Answer |
| Trees | CHRISTMAS TREES | 28 | Answer |
| Carpentry Tools | CIRCULAR SAW | 22 | Answer |
| Carpentry Tools | HAMMER | 12 | Answer |
| Toys | DOLL | 8 | Answer (Generic) |
| Toys | BARBIE DOLL | 20 | Answer (Specific) |

WORD AND CATEGORY GAME

CROSS REFERENCE TO RELATED APPLICATIONS

This is a continuation-in-part of a commonly owned, co-pending patent application, titled "WORD AND CATEGORY GAME", Ser. No. 07/188,317, which was filed in the U.S. Patent and Trademark Office on Apr. 29, 1988.

COPYRIGHT NOTICE

Copyright 1988, 1989 Neil W. Runstein. All Rights Reserved.

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

TECHNICAL FIELD

This invention relates generally to word games. More particularly, this invention relates to a word game having multiple letter tiles and category cards. During play of the present game, the letter tiles are used to compose words which correspond to a category identified on a randomly selected category card.

BACKGROUND ART

Numerous word games used for play by groups of individuals have been previously developed. Such games are often educational, informative and entertaining, insofar as they require the players to compose or guess words which are formed from a limited number of letter pieces and board space.

The following patents relate to word games known in the prior art: Shinn (U.S. Pat. No. 1,312,278; issued Aug. 5, 1919); Brunot, et al. (U.S. Pat. No. 2,752,158; issued June 26, 1956); Hill (U.S. Pat. No. 3,393,914; issued July 23, 1968); Lukacik (U.S. Pat. No. 3,948,526; issued Apr. 6, 1976); Trilling (U.S. Pat. No. 4,014,548; issued Mar. 29, 1977); Kindred (U.S. Pat. No. 4,059,273; issued Nov. 22, 1977); Brzezinski et al. (U.S. Pat. No. 4,306,724; issued Dec. 2, 1981); and Higgins (U.S. Pat. No. 4,384,722; issued May 24, 1983). Another word game, which is not disclosed in the above listed patents, is currently being sold under the trademark "FOUR LETTER FRENZY".

The inventor believes the listed patents and known word games taken alone or in combination neither anticipate nor render obvious the present invention. These citations do not constitute an admission that such disclosures are relevant or material to the present claims. Rather, these citations relate only to the general field of the disclosure and are cited as constituting the closest art of which the inventor is aware.

DISCLOSURE OF INVENTION

It is the general object of the present invention to provide a challenging word game for players by combining vocabulary and categorical knowledge with speed, wit, strategy and luck.

Another object is to provide a word game which encourages the compilation of both short and long words from individual letter tiles which are initially selected at random.

Another object is to provide a word game wherein the word answers must identify a member of a randomly selected category. Another object is to provide a word game wherein the individually, randomly drawn letter tiles are either used by the drawing player or are deposited face-upward upon a game board for use by other players.

Another object is to provide a word game which is simple to play, durable in design, easily constructed, and is inexpensive and economical to manufacture.

The present invention achieves these general and specific objects and presents new apparatus and methods of playing a word game. The present word and category game combines vocabulary and categorical knowledge, at various preselectable intellectual levels, with strategy and luck of the draw.

The objective of the game is for each player to accumulate the most points over a series of rounds. Points are obtained during each round by using a means of letter identification, such as letter pieces, letter tiles, or the like, which each player individually obtains to compose one or more words which belong to a current category. The current category may be chosen by any means capable of randomly selecting such category from a greater pool of categories. In the preferred embodiment, the inventor uses a plurality of category cards from which a single category card is randomly selected. The category for playing the current round is shown at least one surface of the selected category card.

The present invention encourages the formation of both short and long words. This is done by basing score values not only upon the length of the word spelt, but also upon the relative speed with which the players compose such words. Thus, players score points depending upon the speed with which they spell their answers, and upon the number of letter tiles in their possession when the first correct answer is completed.

The present invention differs from most "word" or "knowledge" games in that there may be several or even many correct answers to a particular category used during play. Answers may be short or long, singular or plural, and contain one or more words. For some categories, answers may be either correct or incorrect. For other categories answers may or may not be correct, depending upon the background and point of view of the players. For example, whether or not a person is "famous" or a word is a "synonym" may be rather subjective in some cases, and therefore, alter the correctness of an answer. A certain amount of "give and take" and "fair play" on part of the players is incorporated into this game.

To accomplish the aforesaid objects, the present word game comprises: a pool of categories from which a single category may be randomly selected; and a means of letter identification for composing corresponding words. In the preferred embodiment, the pool of categories comprises a plurality of category cards from which a single category card is drawn. Likewise, in the preferred embodiment, a plurality of letter tiles are used for the means of letter identification. The letter means has a indicia, such as an alphabetic symbol, appearing thereon.

It must be understood, however, that such playing pieces may be formed within numerous other mediums, such as being generated by a computer, or be printed on paper, playing cards, stones, die, or the like. For purposes of clarity, and not by way of limitation, further reference will be made solely to the use of category cards and letter tiles.

During play, a category card is randomly drawn and placed so that all may see the category identified thereon. This category card identifies the category for the current round of the game.

The difficulty of the game may be decreased or increased for any age, language, or intellectual level by using preselected groups or decks of category cards which identify various categories of general to restricted familiarity. For example, the players may choose from different packs of category cards to choose categories having the appropriate difficulty for the players or particular area of interest. Pictorial examples may also be printed on the category cards to help the players understand the scope and definition of the category.

There are preferably six rounds of play in each game, but more or less rounds may also be played.

Following the selection of a category card, a starting player is chosen. The starting player may be chosen by any number of methods commonly known to players of games. The inventor prefers to select the starting player by having each player randomly select a single letter tile from a pool of letter tiles. A letter bag may be provided to contain the pool of initially unused letter tiles. Use of the letter bag is optional. If used, the letter bag functions as an object from the interior of which the letter tiles may be randomly drawn. Any other alternative means of selection may also be used. A comparison is made of each player's selected letter means. The player with a letter closest to the letter "A" in alphabetical order becomes the starting player. After selection of the starting player, all letter tiles are returned to the letter pool within the letter bag, and play begins.

The starting player randomly selects a single letter tile from a pool of letter tiles. The starting player may either use the drawn letter in compiling a word belong to the current category or discard the letter tile for other players to use.

If the player elects to keep the drawn letter tile, the player places the drawn letter tile on the table in front of him or her, away from a general playing area. In the preferred embodiment, the players use letter racks upon which the drawn letter tiles are placed to form each player's word or words.

If the player elects not to use the drawn letter tile, the player places the letter tile into a separate, designated, general playing area for other players to use. If the letter tile is so discarded, the tile should be placed so that the letter appearing thereon is facing upward. A game board may be used to designate the general playing area and identify where the discarded letter tiles must be placed. The general playing area is defined by the upper surface of the game board.

In one embodiment of this invention, players may only obtain or discard letter tiles between the designated playing area, or game board if used, and their respective words, or letter racks if used, when it is their turn to play.

In another embodiment, all players may obtain or discard letter tiles between the designated playing area and their respective words or letter racks at any time during play. Various other degrees of play restriction, including a combination of these two embodiments, may also be used.

Play continues with each successive player in turn randomly selecting a single letter tile from the pool of letter tiles and choosing whether or not to use or discard such letter tile. As stated above, depending upon the rules being played, the drawing player and/or the other players may also obtain or discard letter tiles between the designated playing area and their compiled words during their turn or during the turn of any other player. For the preferred method of play, the reader is referred to the "Best Mode For Carrying Out The Invention" portion of this disclosure as set forth below.

Play ends when one of the players announces that he or she has spelt a word belonging to the current category. Announcement may be made by any appropriate means of communicating such completion. For example, the person who has correctly spelt such a word, may call out-loud a designated name or word. The inventor's trademark may be used for this purpose.

The players must keep all of the letter tiles in their possession at the time of announcement. Possession of unused letter tiles at the end of each round may significantly effect the number of points awarded or deducted from that player's score. Score allocation will be discussed in detail further below.

After announcement, game play stops, the spelling of the announcing player's word is verified, and the relationship or membership of the spelt word to the current category is determined. The word spelt must identify a member of the current category. Unless the chosen category designates a limited number of answers, word selection is otherwise unrestricted.

If the word is misspelt, includes any unused letter tiles, does not properly belong to the current category, or if the player does not properly comply with an applicable special rule appearing on the category card (called a special category card), then all of that players letter tiles are returned to the pool of letter tiles. No points are awarded. Play resumes, and the players, including the announcing player, continue to play.

If the word is properly spelt, does not include unused letter tiles, properly belongs to the current category, and the player complies with all special rules appearing on the special category card, if applicable, then the round is over and each player's score is tallied. A score pad may be used to keep score of the points each player obtains during the game.

The inventor has found the following method of score calculation or allocation to be the most effective. The announcing player receives two points for each letter or blank letter tile used to spell the winning word. All other players receive one point for each letter or blank letter tile used to spell their partial answer or answers. Every letter tile in a player's possession, however, must be used to spell the winning or partial word, and such word or partial word must correctly relate to the currently chosen category.

In the preferred embodiment, no points are awarded to a player who has an unused letter tile in his or her possession at the end of a round. In other words, a player may only receive points if every letter tile in his or her possession at the time of the winning announcement is properly used within a word, and that word belongs to the current category.

In another embodiment, points are deducted from the offending player's accumulated score if at the end of the round that player has unused letter tiles in his or her possession. The penalty may be limited to the loss of a designated number of points or to a single point for that round. Alternatively, the penalty may be the deduction of one point for each unused letter tile in that player's possession at the end of the round.

If the word or partial word uses all of that player's letter tiles but the word is misspelt or does not belong to current category, then that player receives zero points.

Alternative methods for calculating a player's score may be used without changing the intent or scope of the claimed invention.

After a designated number of rounds, such as six rounds in the preferred embodiment, the score of each player is totaled. The player with the most points wins the game.

During game play, the players may choose varying strategies to win. For example, a player may choose to win rounds with short answers and thereby obtain double points for his or her answers. Alternatively, a player may choose to obtain longer answers with the likelihood of obtaining a greater number of single awarded points. Each player may choose his or her own strategy. This adds to the variety and fun of playing the game.

To quicken the pace of the game, prior to play, each player takes as many letter tiles from the pool of letter tiles as the number of the new round about to be played. In other words, each player begins the first round having already drawn a single letter tile from the pool of letter tiles. Similarly, each player begins the second round having drawn two letter tiles, etc., for each successive round.

During the third round, each player may initially draw three letter tiles. During the fourth and successive rounds, each player may initially draw the same number of letter tiles which correspond to the number of the round currently being played.

The pace is even quickened further by allowing all players to draw at will from the discarded letter tiles placed within the general playing area. It is intended, however, that only one letter tile may be drawn at a time. In other words, a player should not have several letter tiles within their hands at one time. Players may only discard letter tiles during their respective turns. A player's turn is terminated once that player retains a letter tile during his or her turn.

If any letter tiles remain within the letter bag, at least one letter tile must be drawn therefrom during each player's turn. A player may continue drawing letter tiles from the letter bag and continuously discard them into the general playing area as long as he or she likes. But, once that player retains a letter tile, then that player's turn is terminated.

These and other objects and advantages of the present invention will become more readily apparent upon reading the following disclosure and referring to the attached drawings.

BRIEF DESCRIPTION OF DRAWINGS

FIG. 5 is a chart of example answers and point scores illustrating point allocation for the preferred embodiment of this invention.

One should understand the drawings are not necessarily to scale and the elements are sometimes illustrated by graphic symbols, phantom lines, diagrammatic representations, and fragmentary views. In certain instances, the inventor may have omitted details which are not necessary for an understanding of the present invention or which render other details difficult to perceive.

BEST MODE FOR CARRYING OUT THE INVENTION

Figure 1:
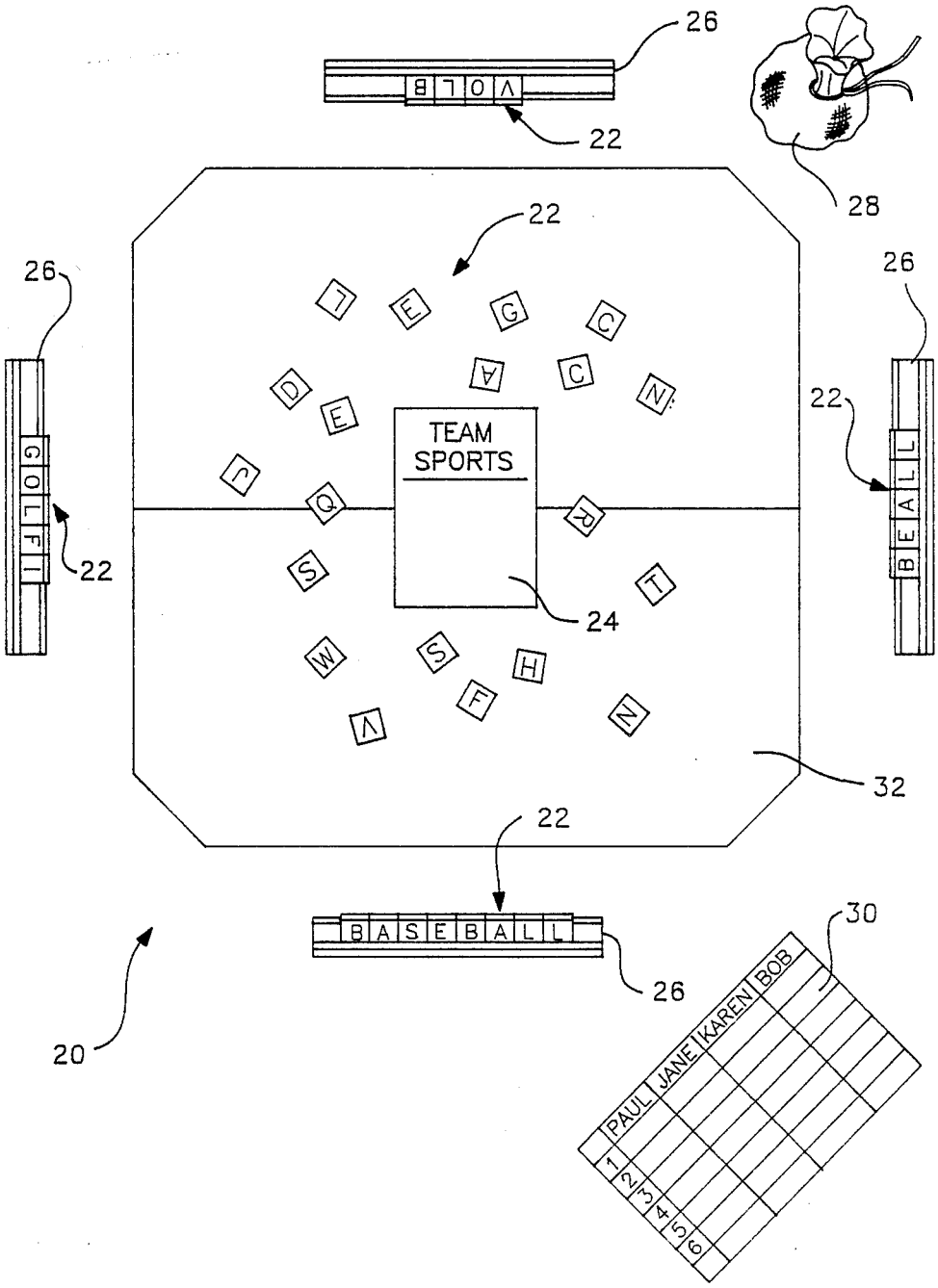
FIG. 1 is a plan view of a game playing area comprising: a playing board; a stack of category cards; a letter bag; a plurality of letter racks; and a plurality of letter tiles.

Referring to the drawings, and particularly to FIG. 1, wherein like numerals indicate like parts, a word game 20 comprises: a plurality of letter tiles 22; and a plurality of category cards 24. Word game 20 may be played by two or more players. In the preferred embodiment, word game 20 is played by two to four players.

The object of word game 20 is for each player to accumulate the highest number of points at the end of a predetermined number of rounds of play. Consequently, word game 20 may comprise a single or several rounds of play. The inventor prefers to use six rounds of play.

During each round, points are obtained by using letter tiles 22 to compose or spell one or more words which properly belong to a category identified on a currently selected category card 24. Such words may be composed or spelt by placing retained letter tiles 22 on letter racks 26.

The first player to use all of the letter tiles 22 in his or her possession to properly complete a word belonging to the current category, and to announce such completion, wins that round. The player with the highest score, after completion of the designated number of rounds of play, wins the game.

In the event of a tie, the tied players may either play a playoff round or agree to be co-winners.

APPARATUS

In the preferred embodiment, word game 20 comprises approximately: one-hundred-fifty-four (154) letter tiles 22; three-hundred (300) category cards 24; eight (8) letter racks 26; a letter bag 28; a score pad 30; and a letter or game board 32. A greater or lesser number of these elements may also be used to practice this invention.

A single alphabetic letter appears on the upper-face of each letter tile 22, except for a few letter tiles 22 which are left blank and may be used as a joker means to represent any desired letter or character. All letters of the English alphabet are included. Preferably, all of the letters appearing on letter tiles 22 are printed in upper-case or capital form. This simplifies not only game play, but also simplifies the printing and manufacturing process. During play, all letters are valid as either upper-case or lower-case letters in any situation where the case of the letter might be significant.

The preferred embodiment of word game 20 has the following letter distribution: eleven (11) "A"; four (4) "B"; five (5) "C"; six (6) "D"; eleven (11) "E"; five (5) "F"; four (4) "G"; four (4) "H"; ten (10) "I"; three (3) "J"; three (3) "K"; six (6) "L"; four (4) "M"; eight (8) "N"; ten (10) "O"; four (4) "P"; two (2) "Q"; eight (8) "R"; nine (9) "S"; eight (8) "T"; six (6) "U"; three (3) "V"; three (3) "W"; two (2) "X"; three (3) "Y"; two (2)

"Z"; and ten (10) blank letter tiles. Other letter distributions may also be used.

In one embodiment, letter tiles 22 are not provided with numerals or punctuation marks printed or appearing thereon. Thus, word forms, such as "3D", which use numerals within their spelling are not possible.

In the preferred embodiment of the present invention, the blank letter tiles 22 ma be used for any desired number or digit.

Letter tiles 22 may also have numerals, punctuation marks, or other symbols appearing thereon. For example, alternative embodiments of this invention may include letter tiles 22 which have different character sets represented thereon. Thus, the present invention may be used with any and all domestic or foreign languages, or for any mathematic or scientific application. In such embodiments, the appropriate written or printed characters are used. Where mathematical or scientific application is desired, the described categories may comprise formulas, numbers, principles, or the like.

Figure 2:
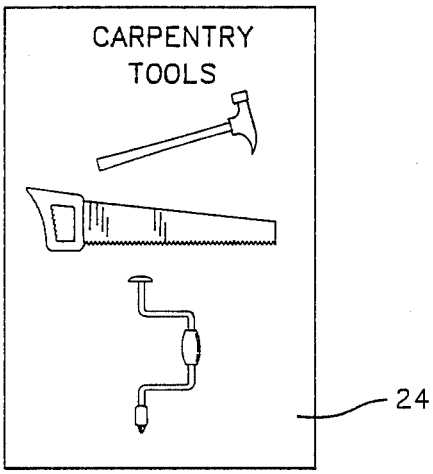
FIG. 2 is an example of a face side of a representative category card.
Figure 3:
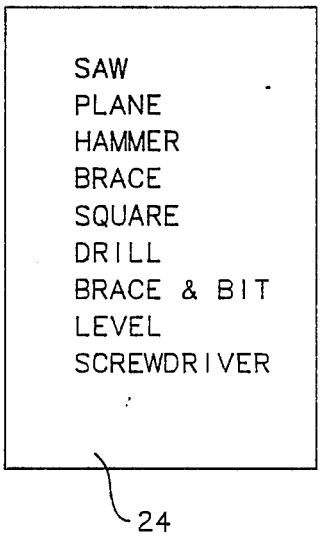
FIG. 3 is an example of a back side of a representative category card.

Each category card 24 has a name of a category appearing on one side or face-side of the card. Pictorial and/or written examples of the designated category may be printed on the same side of the category card 24 as where the category is listed. Such examples may, alternatively, be printed on the opposite or back-side of category card 24. The examples are provided to clarify the meaning of the category, and thereby, save time and effort in verifying answers at the end of each round. Use of the pictorial examples is optional. For example, FIG. 1 shows category card 24 without a pictorial example printed thereon. If pictorial examples appear on the face-side of category card 24, as shown in FIG. 2, a printed list of example words which fall within the category may be printed on the back-side of category card 24, as shown in FIG. 3. Material printed on the back-side of category card 24 should not be referred to prior to or during play of the round.

Although three-hundred (300) category cards 24 are used in the preferred embodiment, a fewer or greater number of category cards 24 may be used. If a majority of players agree that a category is too unfamiliar or difficult to play, that category card 24 may be skipped and a new category card 24 or deck of category cards 24 may be selected.

Special game or category rules may also be included upon special category cards 24'. Category cards 24' will be further described below.

The initial sequence or order of the various category cards 24 may be organized to introduce a variety of categories during the first few rounds of play. Otherwise, there is no significance to the original sequence of category cards 24. Thereafter, players should occasionally shuffle category cards 24.

To assist each player compile their word or words, letter tiles 22 may be placed upon optional letter racks 26. The inclusion of letter racks 26 has structural and functional impact on the game by allowing easy manipulation of letter tiles 22 and enabling the players to conceal their progress during the game from fellow players. Use of letter racks 26 also allows the players to obtain, discard, and manipulate letter tiles 22 without having to hold a large number of such elements within their hands. Lengthy words or even a combination of words can be organized and spelt on letter racks 26. Letter racks 26 also prevent letter tiles 22, which are placed thereon, from inadvertently falling out of place, and enable the players to easily obtain and discard letter tiles 22 with either hand during play.

Each letter rack 26 should be long enough to hold approximately nine (9) or more letter tiles 22 which may be placed thereon in a side by side fashion. Shorter or longer letter racks 26 may also be used. A player may use two or more letter racks 26 if needed. The inventor has found that eight (8) letter racks 26 is sufficient if the game is played by two to four players. Additional letter tiles 22 and letter racks 26 may be provided, if desired. This is particularly helpful when the game is to be played by more that four players.

A means for holding unused letter tiles 22 may also be provided. Such a holding means may comprise an optional letter bag 28 or other similar means. Letter tiles 23 are initially placed within letter bag 28 and then they are individually and randomly drawn from letter bag 28 during the course of play.

Score pad 30 may be used to keep score of each player's points as the game progresses.

Game board 32 may be provided to identify a specific playing area. Discarded letter tiles 22 are individually placed upon and taken from game board 32 during play. Game board 32 is an optional feature. The inventor, however, has found that players are less likely to hoard previously discarded letter tiles 22 when they are required to place such discarded letter tiles 22 within a designated playing area. Use of game board 32 serves this purpose and also provides all players equal access to discarded letter tiles 22. A depression or other similar locating means may be provided within game board 32 to hold one or more category cards 24. The depression in FIG. 1 is shown filled with category cards 24. Alternatively, an external holding means 34, such as a box which holds category cards 24, may be placed upon or beside game board 32.

The method of playing the present game is not restricted to the specific apparatus herein described. For example, the means for letter identification may comprise letter pieces, letter tiles 22, or any other apparatus or method of generating such letters. A computer program may be used to generate such letters. Likewise, the current category may be chosen by any means capable of randomly selecting such category from a greater pool of categories. The current category may be selected from a plurality of category cards 24, tiles, or a data bank which is electronically stored or generated, or the like.

For reasons of simplicity and to maximize ease of operation in both learning and playing the game, the inventor prefers to use letter tiles 22, category cards 24, letter racks 26, and letter bag 28. Such elements may be manufactured for heavy use under normal family conditions, without requiring the purchase of expensive electronic equipment. By using such elements, the game may be manufactured to be extremely durable and may be used by most age groups. For example, use of letter "tiles" 22, made from wood, metal, plastic, or another durable material which does not fold, crease, or bend, avoids many of the problems commonly associated with letter "cards" made from paper or card stock material. Letter "tiles" 22 are also easily held and manipulated, easily inserted and removed from letter bag 28, and are easily stored upon letter racks 26 during play.

This game does not require that the letter selecting or identification means be capable of being shuffled. Nor does such means require the inclusion of numerals thereon. This game also does not require the inclusion of grab bags, or of a particularly designed game board. The omission of such cumbersome, expensive, and extraneous materials, previously thought to be necessary for the operation of word games, simplifies game play, reduces the complexity of the present game, and reduces the cost of its manufacture.

An alternative method of play, however, would be to use the claimed process within a computer generated electronic environment.

The following disclosure will describe the preferred and several other various methods of how word game 20 may be played.

GAME PLAY

The players sit across from one another, preferably, around a square or round table so that each player is generally the same distance from the center of the table. Game board 32 is place near the center of the table.

Each player takes a letter rack 26 and places it beside himself or herself. Players may take and use additional letter racks 26 during play if needed. During play, each player should try to conceal his or her retained letter tiles 22 from the view of the other players.

All, or a desired portion, of letter tiles 22 are placed in letter bag 28. Each player individually removes a single letter tile 22 from letter bag 28. The player selecting a letter tile 22 having a letter nearest the beginning of the alphabet, i.e. the letter "A", has the first turn of the opening round. In subsequent play, the winner of the previous round has the first turn in the succeeding or subsequent round. Once the starting player has been designated, all letter tiles 22 are returned to letter bag 28.

A category card 24 is randomly selected and turned upward so that the category name or title is visible to all players.

Turns are taken by passing letter bag 28. This gives order to the play of the game. A player's turn is terminated when, after having selected a letter tile 22 from letter bag 28, that player retains any newly selected letter tile 22. The newly selected letter tile 22 may be either the letter tile 22 which was drawn from letter bag 28 or is another letter tile 2 which has been discarded into the general playing area.

The first player of the round draws a single letter tile 22 from letter bag 28 and passes letter bag 28 to the next player on his or her left. Play continues around the table in a clockwise fashion, with each successive player drawing a single letter tile 22 from letter bag 28 and passing letter bag 28 along from player to player. The player whose turn it is to draw a letter tile 22 from letter bag 28 must do so if any letter tiles 22 remain within letter bag 28.

Word game 20 naturally moves at a brisk pace. There are no rules regarding the time it takes to draw a letter tile 22 from letter bag 28 or to move letter tiles 22 to or from a player's letter rack 26. The players must, however, promptly draw a letter tile 22 from letter bag 28 during their turn and pass letter bag 28 on to the next player.

If a player wants to keep a letter tile 22 which he or she drew from letter bag 28, the letter tile 22 is place upon that player's letter rack 26.

If a player does not wish to keep the drawn letter tile 22, then the letter tile 22 is discarded by placing letter tile 22 face-upward on game board 32 so that all players may see the letter appearing thereon.

To quicken the pace of the game, prior to play, each player takes as many letter tiles 22 from letter bag 28 as the number of the new round about to be played. In other words, each player begins the first round having already drawn a single letter tile 22 from the pool of letter tiles. Similarly, each player begins the second round having drawn two (2) letter tiles 22. Each player begins the third round having drawn three (3) letter tiles 22. Each player begins the fourth round having drawn four (4) letter tiles 22. Each player begins the fifth round having drawn five (5) letter tiles 22. Each player begins the sixth round having drawn six (6) letter tiles 22 from letter bag 28.

The pace is even quickened further by allowing all players to draw at will from the discarded letter tiles 22 which are placed within the general playing area. It is intended, however, that only one letter tile 22 may be drawn at a time. In other words, a player should not have several letter tiles 22 within his or her hands at one time. This rule, however, is optional. Players may only discard letter tiles 22 during their respective turns.

A player may continue drawing letter tiles 22 from letter bag 28 and continuously discard such drawn letter tiles 22 into the general playing area as long as he or she likes. But, once that player retains a letter tile 22, then that player's turn is terminated. In other words, a player's turn is terminated once that player retains a letter tile 22 after that player has drawn a letter tile 22 from letter bag 28.

In the preferred embodiment, a player may take any number of individual letter tiles 22 from game board 32 or discard any number of letter tiles 22 to game board 32 during that player's turn, before drawing a letter tile 22 from letter bag 28. Thereafter, once a letter tile 22 is retained, that player's turn is terminated. The player may also claim an answer during his or her turn. After completing the turn, the player must pass letter bag 28 to the player on his or her left. Other players may not discard letter tiles 22 from their letter racks 26 until it is their turn to play. Other players, however, may at any time during play, individually obtain and then retain any number of letter tiles 22 which have been discarded onto game board 32.

In another fast-action embodiment of the present invention, all players may move their letter tiles 22 back and forth between game board 32 and their letter racks 26 at any time prior to the announcement of a winning word. The players remain taking turns passing and removing letter tiles 22 from letter bag 28 until all of the letter tiles 22 have been removed.

To prevent players from hoarding letter tiles 22, each player is allowed to hold only one letter tile 22 at a time in his or her hands.

Each player must not obstruct other players' view of game board 32 or their access to letter tiles 22 which are placed upon game board 32. Distracting motions should be avoided. A player who moves his or her hand towards game board 32 as if to take a letter tile 22 must actually take a letter tile 22 unless the letter tile 22 is taken first by another player. If two players grasp the same letter tile 22 on game board 32 at precisely the same time in an effort to move that letter tile 22 to their respective letter racks 26, the letter tile 22 at issue is returned to letter bag 28.

In both of the above embodiments, letter bag 28 is passed from player to player with each player drawing one or more letter tiles 22 from the interior of the bag.

Play continues until a player announces that he or she has formed a word.

In the preferred embodiment, the first player to compose a correctly spelt word, which relates to the category shown on the current category card 24, makes such an announcement by calling out a specified word or name. The inventor prefers that the word or name used for announcement be the trademark under which the game will be sold. In this way, the inventor's trademark is reinforced within the minds of the players and spectators. Currently, the game is being sold under the trademark "WordHound".

Immediately after announcement, each letter tile 22 in a player's hand must be placed on his or her respective letter rack 26. The only exception to this rule is that the player with letter bag 28 may place the letter tile 22 drawn from letter bag 28 either onto game board 32 or onto his or her letter rack 26. This exception is provided so that players cannot sabotage another player by waiting until the other player has drawn a letter tile 22 before calling out the specified word or name. This rule is inapplicable, however, if the player having letter bag 28 is the only one allowed to announce completion.

No further moves are made until the spelling of the announcer's word and its relationship to the current category is verified. Disputes and questionable answers should be resolved by consulting an encyclopedia, atlas, dictionary, or other reference source. Reference to a dictionary or other source, however, is recommended only if it is needed to verify the spelling or meaning of a word after a winning word is announced. A majority vote of the player may dispense with any dispute or questionable answer if a reference source is unavailable.

Use of a dictionary or other reference source during play is optional, provided the play is not significantly detained. In particular, the player whose turn it is to draw from letter bag 28 must not detain play of the game to refer to a dictionary or other reference source.

By agreement of the players, use of a reference book during play may be disallowed.

If necessary, players may create a new rule to resolve a dispute or questionable answer, or deal with a situation which is not discussed herein.

At the start of each new round, all letter tiles 22 are returned to letter bag 28 and a new category card 24 is drawn and turned upward so that all players may see the category listed. The winner of the previous round draws the first letter tile 22 in the subsequent round.

After the designated number of rounds have been played, the score for each player is totaled. The player with the highest score wins the game. In the event of a tie for the highest score, the tied players may either play one or more playoff rounds or agree to be co-winners.

SCORING

Positive score values are awarded to players who have used all of their retained letter tiles 22 to correctly spell or partially spell an answer relating to the current category at a time when the first player to spell a word announces such completion. Scoring is not dependent upon the players' success in complying with complex requirements set forth upon an intricately designed game board.

An answer in each round of the present game may comprise one or more words or be singular or plural. A multiple word answer is considered a single answer which has more than one word. For example, the answer "BACK SAW" is a valid answer for the category "Carpentry Tool". The answer "HAMMER AND SAW" would not be a valid answer. Another example involves the first name and/or the middle name or initial of a person, which is optional. For example, either "WASHINGTON" or "GEORGE WASHINGTON" is correct for the category of "A President Of The United States". The indefinite article "the" and the definite article "a" are also optional in names or titles. For example, both "BEATLES" and "THE BEATLES" are correct answers for the category "Rock Band". Each of these examples illustrates the use of multiple words which form a single answer. Only a single answer is valid unless otherwise noted on the current category card 24.

Words having a plurality format are valid provided they relate to the current category. For example, the answer "BASEBALLS" is valid for the category "Sports Equipment" but is not valid for the category "Team Sport". Similarly, "LEAF" and "LEAVES" are both valid for the category "Part Of A Tree".

Common short forms of words are also valid. For example, the words "AUTO" and "AUTOMOBILE" are both valid answers for the category "Conveyance, As In A Vehicle".

Punctuation such as apostrophes, hyphens, and blanks spaces between words are assumed and do not affect scoring.

Blank letter tiles 22 may be used as any letter and are counted as a letter for scoring purposes.

If a word is incorrectly spelt, a "Bad Spelling" or "BS" rule is invoked. An example of an incorrect spelling variant would be the word "LEAK" for the category "Vegetable", the correct spelling being "LEEK".

If the word does not correctly relate to the current category, a "Wrong Category" or "WC" rule is invoked. An example of a wrong category error would be the word "LIZARD" for the category "Mammal".

Figure 4:
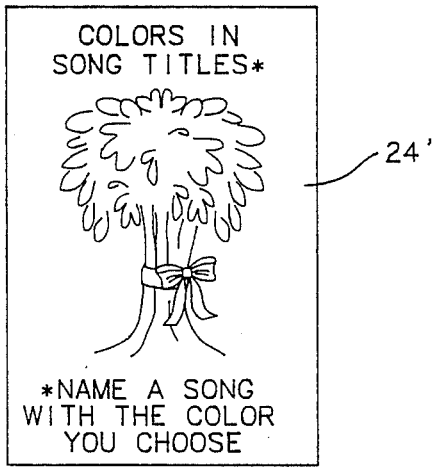
FIG. 4 is an example of a face side of a representative special category card.

A special category rule may also apply. In the preferred embodiment, a special category name is printed on the top of a special category card 24' and an asterisk (*) or some other indicator is printed beside it. A corresponding special rule is printed on the bottom of the special category card 24'. The special rule is also highlighted by having an asterisk (*) printed thereby. FIG. 4 is an example of a face-side of a special category card 24'. An example of a special category is the category "Colors In Song Titles*". A corresponding special rule may be: "*Name A Song With The Color You Choose". A player claiming the word "BLUE" as an answer to the current category would have to name a song with the word "BLUE" in the song's title. If the player met the other requirement and named aloud the song "Blue Moon", or any other song with "BLUE" in the title, he or she would win the round and score eight points, two points for each letter in the word "BLUE". If the player did not correctly name a song with the word "BLUE" in the title, on the first attempt, the player would violate the "Special Rule" or "SR" rule.

If the word is incorrectly spelt (i.e. "Bad Spelling" violation), does not relate to the current category (i.e. "Wrong Category" violation), or violates a "Special Rule", then the announcing player is penalized by returning all of his or her retained letter tiles 22 to letter bag 28, and play resumes. The penalized player continues to play.

The "Bad Spelling", "Wrong Category", and "Special Rule" rules apply not only to the announced answer, but also to any partial answer a player has on his or her rack when the round ends. A player against whom any of these rules is invoked when the round ends scores at most zero points for that round. If that player has any unused letters, the player may even receive negative points, depending upon which embodiment of the invention is being played.

If the announcing player's word is spelt correctly, irrespective of punctuation, and correctly belongs to the current category, then that round is over and each player's score for the round is computed.

The winner of a round scores two (2) points for each letter tile 22 used to spell the winning word. If two players announce the specified word or name at precisely the same time, both players score two points for each letter tile in their properly spelt and category related winning word. The remaining players score one (1) point for each letter tile 22 in their partial correct answers. All answers or partial answers, however, must be correctly spelt, must relate to the category listed on the current category card 24, and every letter tile 22 in the player's possession must be used to spell the answer or partial answer.

If a player has one or more unused letter tiles 22 at the end of a round, that player does not get any points for the correctly used letter tiles 22. In the preferred embodiment, a player having one or more unused letter tiles 22 at the end of a round receives zero (0) points for that round.

A more challenging embodiment of this game is where each player having one or more unused letter tiles 22 at the end of a round not only does not receive any points for the round, but is penalized by deducting one or more points from his or her accumulated score. For example, one point could be deducted for each unused letter tile 22 in the possession of that player at the end of the round. Such penalties are intended to discourage players from hoarding letter tiles 22.

The following examples illustrate how points are computed in the preferred embodiment where no penalty points are given.

If the category were "Team Sport" and the winning word was "BASEBALL", then the announcing player would receive a score of sixteen (16) points for that round, two points being given for each of the eight letter tiles 22 used to spell "BASEBALL". If at the end of the round, another player has only the letter tiles 22 which spell "SEALL", which were being used in an attempt to spell either "BASEBALL" or "BASKETBALL", then that player would receive a score of five (5) points, one point for each of the five letter tiles 22 used to spell "SEALL".

If a player possesses unused letter tiles 22 at the end of the round, then no points are given for the properly used letters. Using an example similar to the one discussed above, the letter tiles 22 which spell "SEALLZ" or "SEALLLZ" are worth zero (0) points. If penalty points are given, as suggested in the second embodiment, then a score of negative one (−1) point and a score of negative two (−2) points would have been respectively given to the preceding answers. Other examples of scoring are shown in the chart in FIG. 5.

If a player fails to announce a possible winning answer or if a player is not the first to announce a possible winning answer for that round, then that player scores only one point for each letter tile 22 properly used to spell a word belonging to the current category, provided, he or she does not have any unused letter tiles.

The means and construction disclosed herein are by way of example and comprise primarily the preferred form of putting the invention into effect. Although the drawings depict a preferred and alternative embodiments of the invention, other embodiments have been described within the preceding text. One skilled in the art will appreciate that the disclosed device may have a wide variety of shapes and configurations. Additionally, persons skilled in the art to which the invention pertains might consider the foregoing teachings in making various modifications, other embodiments, and alternative forms of the invention.

It is, therefore, to be understood that the invention is not limited to the particular embodiments or specific features shown herein. To the contrary, the inventor claims the invention in all of its forms, including all alternatives, modifications, equivalents, and alternative embodiments which fall within the legitimate and valid scope of the appended claims, appropriately interpreted in accordance with the Doctrine of Equivalents.

INDUSTRIAL APPLICABILITY

This invention is particularly effective and well adapted to entertain and educate groups of two or more players. Play preferably comprises six round wherein an announcing player and other players may obtain points. The points are allocated to the various players based upon their speed and accuracy in spelling words belonging to a randomly selected category. Zero or negative points may be allocated for words or portions of words which are incorrectly spelt, do not relate to the current category, or which violate an applicable special rule. This word and category game is fast paced and may be adapted to challenge and teach any age or intellectual level of players.

I claim:

1. A method of entertaining a plurality of players by playing a word and category game comprising the steps of:

(a) choosing a starting player to begin a round of play;

(b) drawing a randomly selected category means having a category identified thereon from a selection of category means;

(c) said starting player drawing a randomly selected, initial letter means from a general pool of letter means;

(d) said starting player either retaining said initial letter means in an attempt to compose or partially compose a word or words belonging to said category or discarding said initial letter means into a general playing area;

(e) each of said players drawing at will said discarded letter means from said general playing area for retention in an attempt to compose or partially compose a word or words belonging to said category;

(f) rotating turns among said players, each player (i) being allowed to discard its retained letter means into said general playing area, (ii) drawing a randomly selected letter means from said general pool if any letter means remain therein, (iii) either retaining said drawn letter means, in an attempt to compose or partially compose a word or words belonging to said category, or discarding said drawn letter means into said general playing area, (iv) if all retained letter means of said player are used to complete a word or words which properly belongs to said category, announcing such completion; and (g) calculating a score for each of said players for said round of play.

2. The method of claim 1, wherein said step of choosing said starting player to begin a first round of play comprises the steps of:

(a) each of said players drawing a randomly selected letter means from said general pool of letter means;

(b) comparing said selected letter means;

(c) identifying which player selected a letter means having a indicia nearest to a preselected indicia, said player having a letter means whose indicia is nearest said preselected indicia acting as said starting player for said first round of play; and (d) returning said selected letter means to said general pool.

3. The method of claim 1, further comprising the steps of playing a plurality of rounds.

4. The method of claim 3, wherein six rounds are played.

5. The method of claim 3, wherein said announcing player of a next preceding round is chosen as said starting player for a next subsequent round of play.

6. The method of claim 1, wherein each of said letter means has either a blank or a single indicia appearing thereon.

7. The method of claim 6, wherein said letter means which do not have an indicia appearing thereon, but rather are blank, serve as joker means tiles which may be used during play to represent any desired indicia.

8. The method of claim 1, wherein said letter means comprises a letter tile.

9. The method of claim 6, wherein said indicia comprises an alphabetic character.

10. The method of claim 1, wherein said general pool of letter means comprises a plurality of letter tiles placed within an interior of a letter bag, said letter tiles being initially placed within said letter bag.

11. The method of claim 10, wherein each player draws an individual, randomly selected letter tile from within said interior of said letter bag during said player's respective turn.

12. The method of claim 1, wherein said category means has a category name appearing thereon.

13. The method of claim 1, wherein a plurality of said category means have at least one pictorial example of a member of said category illustrated thereon.

14. The method of claim 1, wherein said selection of category means comprises a deck of cards, each of said cards defining a category means.

15. The method of claim 1, wherein a portion of said category means comprises a special category means, each of said special category means having a category and a corresponding special category rule appearing thereon, said category means and said special category means being commingled with one another such that said special category cards may be individually and randomly selected to identify said current category for a round of play, said retained letter means being used by each of said players to form a word relating to said current category and to comply with said special category rule.

16. The method of claim 2, wherein said letter means are discarded into said general playing area in a manner such that said players may see said indicia appearing thereon.

17. The metod of claim 1, wherein said general playing area is defined by an upper surface of a game board, said letter means being placed upon said game board when discarded by said players.

18. The method of claim 17, wherein said game board has a depression located therein to hold said category means.

19. The method of claim 1, wherein said retained letter means are placed upon one or more letter racks.

20. The method of claim 1, further comprising the step of allocating points for each said word or partial word of said players.

21. The method of claim 1, wherein a positive score value is given to each of said players who have used all of their retained letter means to correctly spell or partially spell a word or words relating to said current category at a time when a first of said players to spell an appropriate word or words announces such completion.

22. The method of claim 1, wherein said announcement is made by calling out loud a predetermined word.

23. The method of claim 1, wherein multiple points are awarded for each retained letter means used to complete a word or words which properly belongs to said category, if all of said retained letter means of said player are used to complete said word or words and said player is a first player to announce such completion during said round of play.

24. The method of claim 1, wherein single points are awarded for each retained letter means used to complete or partially complete a word or words which properly belongs to said category, all retained letter means of said player being correctly used within said complete or partial word or words and said player not being a first player to announce completion.

25. The method of claim 1, wherein said score is calculated by awarding:

(a) to said player who properly announces completion, two points for each letter means correctly used to spell said word or words which properly relates to said category;

(b) to said other players, one point for each letter means correctly used to spell said partial word, word or words which properly relates to said category; and (c) zero points to each player who has retained one or more letter means which are not used within said word or partial word related to said category.

26. The method of claim 1, further comprising the step of recording said scores of each of said players on a score pad.

27. The method of claim 3, further comprising the step of calculating a score for each of said players for said plurality of rounds of play.

28. A method of entertaining a plurality of players by playing a game comprising the steps of:

(a) choosing a starting player to begin a current round of play;

(b) drawing a randomly selected category from a selection of categories;

(c) said starting player drawing a randomly selected letter means from a pool of letter means;

(d) said starting player either retaining said drawn letter means to compose or partially compose a word related to said category or discarding said letter means into a general playing area for other players to use;

(e) transferring a turn of play to a subsequent player;

(f) said subsequent player being permitted to draw and discard said letter means between said general playing area and said retained letter means of said subsequent player;

(g) said subsequent player randomly drawing another of said letter means from said pool if any letter means remain therein;

(h) said subsequent player either retaining said drawn letter means to compose or partially compose a word related to said category or discarding said letter means into said general playing area; and (i) continuing steps (e), (f), (g) and (h) until one of said players announces completion of a word or words which properly relates to said category.

* * * * *